United States Patent [19]

Hamano et al.

[11] 4,217,566

[45] Aug. 12, 1980

[54] IN-LINE TYPE COLOR PICTURE TUBE APPARATUS

[75] Inventors: Eizaburo Hamano; Hisafumi Okada, both of Kumagaya; Hidetoshi Yamazaki, Fukaya, all of Japan

[73] Assignee: Tokyo Shibaura Electric Co., Ltd., Kawasaki, Japan

[21] Appl. No.: 908,852

[22] Filed: May 23, 1978

[30] Foreign Application Priority Data

May 30, 1977 [JP] Japan ..... 52-62222

[51] Int. Cl.[2] ..... H01F 3/12

[52] U.S. Cl. ..... 335/212; 335/210

[58] Field of Search ..... 335/212, 213, 210

[56] References Cited

U.S. PATENT DOCUMENTS

| | | | |
|---|---|---|---|
| 3,376,450 | 4/1968 | Franklin | 335/212 |
| 4,109,220 | 8/1978 | Peart | 335/212 |

FOREIGN PATENT DOCUMENTS 38-8764 6/1963 Japan .

OTHER PUBLICATIONS

Barkow et al., "DAS 110°—Precision-In-Line Fernseh-Farbbildrohren-System", NTZ—Kurier, (1975 epk K96-K99).

Seifert et al., "Farbbildrohre A66-600X und Ablenkeinhert AEF 1089, Bauelemente eines Selbstkonvergierenden Farbfernseehsystem", Techn. Mitt. AEG—Telefunken, (1975, pp. 242-246).

Brown, "Die Selbstkonvergierende Ablenkmittelserie FTX", Funk—Technik, (1976, pp. 764-767).

Haantjes et al, "Errors of Magnetic Deflection, I", Philips Res. Rep. 12, 46-68, 1959.

Haantjes et al, "Errors of Magnetic Deflection, II", Philips Res. Repts. 14, 65-67, 1959.

*Primary Examiner*—Harold Broome

*Attorney, Agent, or Firm*—Cushman, Darby & Cushman

[57] ABSTRACT

Disclosed is an in-line type color picture tube apparatus which comprises an in-line type color picture tube including a phosphor screen for displaying a substantially rectangular picture with horizontal, vertical, and diagonal axes and an in-line electron gun arranged in parallel with the horizontal axis so as to be allowed to cast electron beams on the phosphor screen to reproduce a color image, a deflection yoke disposed around the outer periphery of the tube and generating such a magnetic field that may give positive isotropic astigmatism to the electron beams when the electron beams are deflected along the horizontal axis, may give negative isotropic astigmatism to the electron beams when the electron beams are deflected along the vertical axis, and may give negative anisotropic astigmatism to the electron beams when the electron beams are deflected along the diagonal axes, and a correction deflection element formed of a plurality of permanent magnets arranged in the vicinity of the end portion of the deflection yoke on the phosphor screen side, generating such a magnetic field that may diagonally constrict the end portions of the diagonal axes of a raster formed of the electron beams by means of an action of the deflection yoke and give positive anisotropic astigmatism to the electron beams when the electron beams are deflected along the diagonal axes. According to this in-line type color picture tube apparatus, raster distortion may be corrected practically completely without using a correction circuit, and self-convergence system may be realized.

5 Claims, 25 Drawing Figures

IN-LINE TYPE COLOR PICTURE TUBE APPARATUS

BACKGROUND OF THE INVENTION

This invention relates to an in-line type color picture tube apparatus composed of an in-line type color picture tube and a deflection means for forming a scanning raster by horizontally and vertically deflecting electron beams.

More specifically, this invention relates to a color picture tube apparatus of the so-called auto-convergence type which allows three electron beams to be automatically converged onto a phosphor screen, substantially reducing raster distortion and eliminating the need of a correction circuit for correcting the raster distortion.

Usually, an in-line type color picture tube apparatus has such a construction as shown in FIG. 1. In an apparatus as shown in FIG. 1, a phosphor screen composed of phosphor stripes in three colors—blue, green and red—are formed on the inside of a glass panel 1, a shadow mask 2 with a number of slots as a color selecting electrode is set behind the phosphor screen at a fixed distance therefrom, and further an electron gun 3 to produce three electron beams is disposed in back of the shadow mask 2. Outside a funnel cone section 4, there is provided a deflection yoke 5 for electromagnetically deflecting the electron beams. The deflection yoke is generally formed of at least each one pair of horizontal coils and vertical coils and a deflection yoke core.

Since the convergence characteristics of the three electron beams may substantially be determined by a magnetic field generated by the deflection yoke, it is a matter of significance to set the distribution of the magnetic field. Thus, in order to facilitate the understanding of this invention, there will be given a brief description of the convergence characteristic and the magnetic field of the deflection yoke in a conventional color picture tube apparatus.

As shown in FIG. 2, electron beams 6B and 6R cause a convergence error when they reach a phosphor screen 7 through a common deflection magnetic field, and a convergence point 8 of the electron beams 6B and 6R has a locus 9 as indicated by a dotted line bending toward the electron gun 3. Strictly speaking, the convergence point 8 of both side beams 6B and 6R is not always in alignment with a central beam 10, so that there may usually be caused the coma error as it is called. FIG. 3 shows patterns on the phosphor screen, indicating the effect of such convergence error. The central portions R, G and B of the patterns indicate the electron gun arrangement as viewed from the phosphor screen side. Further, patterns a, b and c are patterns formed by means of blue, green, and red electron beams, respectively.

In order to achieve accurate reproduction of image on the color picture tube apparatus, it is necessary to correct the aforesaid convergence error and converge the three electron beams substantially all over the phosphor screen. As the main method to attain this, there has conventionally been used a system in which dynamic convergence correction is performed by means of a correction circuit or the like. Nowadays, however, there is generally used an auto-convergence system in which three electron beams are converged substantially on the phosphor screen by taking advangage of the in-line type electron gun to turn the magnetic field into an astigmatic magnetic field mentioned as follows. That is, the astigmatic magnetic field in the latter system includes a pincushion shaped horizontal-deflection magnetic field and a barrel-shaped vertical-deflection magnetic field. FIGS. 4A and 4B show the magnetic field distribution of the pincushion-shaped horizontal-deflection magnetic field and the barrel-shaped vertical-deflection magnetic field, respectively. In FIGS. 4A and 4B, the axis of the color picture tube is supposed to be the central axis, the X-axis is taken in the horizontal deflection direction, and the Y-axis is taken in the vertical deflection direction. FIGS. 5A to 5D show the magnetic field intensity distribution on a section perpendicular to the tube axis. FIG. 5A shows magnetic field intensity $B_Y$ at position $A_1$–$A_2$ on the X-axis and position $B_1$–$B_2$ optionally distant in the Y-axis direction from the center in FIG. 4A, as measured along the X-axis direction. FIG. 5B shows magnetic field intensity $B_X$ at position $C_1$–$C_2$ optionally distant in the X-axis direction from the center in FIG. 4A, as measured along the Y-axis direction. Similarly, FIG. 5C shows magnetic field intensity $B_X$ at position $D_1$–$D_2$ on the Y-axis and position $E_1$–$E_2$ optionally distant in the X-axis direction from the center in FIG. 4B, as measured along the X-axis direction, while FIG. 5D shows magnetic field intensity $B_Y$ at position $F_1$–$F_2$ optionally distant in the Y-axis direction from the center in FIG. 4B, as measured along the X-axis direction. As may be clear from FIGS. 5A and 5B, the magnetic field intensity at positions $A_1$–$A_2$ and $B_1$–$B_2$ increases as these positions recede from the center along the X-axis, while the magnetic field intensity at position $C_1$–$C_2$ is reduced as the position recedes from the center along the X-axis. Further, as may be seen from FIGS. 5C and 5D, the barrel-shaped magnetic field has a characteristic contrary to that of the pincushion-shaped magnetic field.

Now it will be described by means of patterns of three electron beams on a phosphor screen that the convergence error may be corrected by changing the deflection magnetic field into the aforementioned astigmatic magnetic field. First, FIG. 6 shows patterns of the three electron beams when the horizontal and vertical magnetic fields are uniform. As is clear from FIG. 6, the three electron beams 13B(x), 13G(o) and 13R(Δ) are subject to over-convergence in the horizontal direction with respect to any of the horizontal, vertical, and diagonal axes. This may be explained by means of the convergence error as illustrated in FIG. 2. In FIG. 6 the respective loci 14B, 14G and 14R of the three electron beams intersect one another to form the so-called inverse-cross pattern, the loci 14R and 14B tilting to the left and right, respectively, at the upper-side portion. Then, where the horizontal-deflection magnetic field, in such pattern, is supposed to be pincushion-shaped, this pincushion shaped magnetic field functions so as to give positive isotropic astigmatism to the three electron beams, that is, toward under-convergence, thereby gradually reducing the space between side electron beam spots 15B and 15R owing to convergence, as shown in FIG. 7. It is a matter of course that a central electron beam 15G will not always converge on the same point with the side electron beams 15B and 15R, owing to coma error. On the other hand, where the vertical magnetic field is barrel-shaped, the barrel magnetic field functions so as to give negative anisotropic astigmatism to the three electron beams, that is, toward under-convergence, thereby gradually reducing the space between side electron beam spots 16B and 16R to attain the state of underconvergence, as shown again in FIG. 7. Meanwhile, the convergence characteristic of the diagonal-axis end portions, when both the pincushion- and barrel-shaped magnetic fields are given at the same time and the electron beams are deflected in the diagonal axis directions, depends on the deflection angle and image size of the color picture tube, so that it cannot easily be determined. Therefore, there is usually used an optionally designed deflection yoke, and an experimental modification is made while observing the convergence characteristic appearing on the phosphor screen, thereby optimizing the magnetic field.

Thus, in the in-line type color picture tube apparatus as aforesaid, at least the side beams may be converged on the phosphor screen by making the horizontal-deflection magnetic field pincushion-shaped and the vertical-deflection magnetic field barrel-shaped, though the central beam fails to be in alignment with the side beams owing to the so-called coma error, as has already been mentioned. As shown in FIG. 8, the coma error may be corrected by rendering the polarity of the magnetic field distribution on the electron gun side 17 of the deflection yoke opposite to that of the phosphor screen side 18 (e.g., barrel-shaped on the electron gun side and pincushion-shaped on the phosphor screen side, in the horizontal magnetic field), and making the horizontal magnetic field pincushion-shaped and the vertical magnetic field barrel-shaped, as a whole. In order to obtain such magnetic field, however, the phosphor screen side of the vertical magnetic field must have an extreme pincushion shape. In that case, the pincushion-shaped raster distortion becomes very large especially in the horizontal direction. The reason for this is that the raster distortion is substantially affected by the magnetic field near the screen. The raster distortion is caused because the moving speed of beam spots on the phosphor screen increases as they approach the end portion, not in proportion to the deflection angle, and such a tendency is especially marked with a color picture tube with a wide deflection angle. For example, the horizontal raster distortion of a color picture tube with a deflection angle of 110° may be as high as approximately 15%, which cannot be corrected by means of a correction circuit including passive elements. As shown in FIG. 9, both the vertical and horizontal raster distortions are pincushion-shaped in the case of the in-line type color picture tube. In particular, the extent of the vertical raster distortion, which is smaller than the horizontal raster distortion because the horizontal-deflection magnetic field is pincushion-shaped as a whole, may be set at some 2 or 3% in a tube with a deflection angle of 110°.

Well-known as another method for correcting coma error is a method to use the so-called "field controller". According to the field controller method, the degree of freedom in design of the deflection yoke is increased, and hence the three electron beams may satisfactorily be autoconverged even with such a magnetic field as shown in FIG. 10. Even with this method, however, the extent of the horizontal raster distortion will remain as high as approximately 8% and 5% in 110° and 90° tubes, respectively, requiring a correction circuit including passive elements for correction.

In the case of a monochromatic picture tube, such raster distortion may be corrected by arranging a pair of permanent magnets 20 in positions facing each other beside the end portion 19 of the deflection yoke on the phosphor screen side, as shown in FIG. 10. In the case of an in-line type color picture tube, however, the diameter of an imaginary electron beam formed of three electron beams usually ranges from approximately 10 to 16 mm, which is longer beyond comparison than the diameter of the electron beam of the monochromatic picture tube ranging from 2 to 3 mm. Thus, the arrangement of such permanent magnets will lead to a substantial convergence error. Accordingly, the raster distortion in the in-line type color picture tube is generally corrected by means of a correction circuit, and it has been considered impossible to provide a magnetic field capable of reconciling the correction of the raster distortion with the convergence by means of the deflection yoke itself. In general, the use of circuits should preferably be avoided for reducing production cost and making manufacturing processes simple, so that it has been required to eliminate the correction circuit for correcting the raster distortion.

SUMMARY OF THE INVENTION

An object of this invention is to provide an in-line type color picture tube with an outstanding convergence characteristic, enabling the correction of raster distortion without using a correction circuit.

According to the invention, there is provided an in-line type color picture tube apparatus comprising an in-line type color picture tube including a phosphor screen for displaying a substantially rectangular picture with horizontal, vertical, and diagonal axis and an in-line electron gun arranged in parallel with the horizontal axis so as to be allowed to cast electron beams on the phosphor screen to reproduce a color image, a deflection yoke disposed around the outer periphery of the tube and generating such a magnetic field that may give positive isotropic astigmatism to the electron beams when the electron beams are deflected along the horizontal axis, may give negative isotropic astigmatism to the electron beams when the electrom beams are deflected along the vertical axis, and may give negative anisotropic astigmatism to the electron beams when the electron beams are deflected along the diagonal axes, and a correction deflection element formed of a plurality of permanent magnets arranged in the vicinity of the end portion of the deflection yoke on the phosphor screen side, generating such a magnetic field that may diagonally constrict in the vicinity of the end portions of the diagonal axes a raster formed of the electron beams by means of an action of the deflection yoke and give positive anisotropic astigmatism to the electron beams when the electron beams are deflected along the diagonal axes.

DETAILED DESCRIPTION OF THE PREFERRED EMBODIMENTS

In the in-line color picture tube of this invention, there is used as a deflection means a combination of a deflection yoke for subjecting electron beams to astigmatism and a correction deflection element formed of a plurality of permanent magnets to provide a pincushion magnetic field. That is, by superimposing the pincushion magnetic field of the permanent magnets over the astigmatic magnetic field of the deflection yoke, non-convergence caused by the astigmatic magnetic field may be countervailed, thus diagonally constricting the raster. Consequently, the raster distortion may be corrected without involving any convergence error. Thus, this invention can reconcile the convergence and the correction of the raster distortion without employing a correction circuit by combining the dynamic magnetic field of the deflection yoke with the static magnetic field of the permanent magnets.

Now there will be described an embodiment of the invention with reference to the accompanying drawings.

Figure 12:
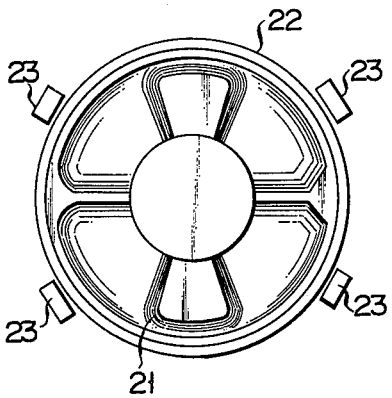
FIG. 12 is a plan of a deflection means used with the in-line type color picture tube according to an embodiment of this invention.
Figure 13:
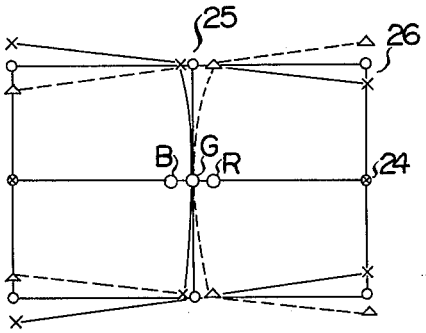
FIG. 13 shows the shape of a raster formed by means of a magnetic field generated by the deflection yoke of FIG. 12 only.

FIG. 12 shows an example of the deflection means used with the in-line type color picture tube apparatus of the invention. Referring to FIG. 12, the deflection means is formed of a deflection yoke 22 and four permanent magnets 23 arranged in positions near the phosphor-screen-side end portion of the deflection yoke 22 and corresponding to the diagonal directions of a phosphor screen. The deflection means is so designed that the magnetic field of the deflection yoke 22 may give positive isotropic astigmatism to three electron beams for substantially good convergence when deflecting these electron beams along the horizontal axis, may give negative isotropic astigmatism to the electron beams for substantial under-convergence when deflecting the beams along the vertical axis, and hence may give negative anisotropic astigmatism to the beams to obtain the so-called inverse cross pattern with respect to the horizontal line or substantial non-convergence with respect to the vertical line when deflecting the beams along the diagonal axes. FIG. 13 shows the states of convergence 24, under-convergence 25, and non-convergence 26. The correction deflection element 23 functions so as to constrict the raster formed of the deflection yoke 22 at least in the directions of the diagonal axes, providing such a magnetic field that may give positive anisotropic astigmatism to the electron beams when they are deflected along the diagonal axes. The raster distortion is corrected and the non-convergence is countervailed by means of the pincushion shaped magnetic field of the correction deflection element 23. Although the magnetic field of the aforementioned deflection yoke 22 is, more specifically, the so-called astigmatic magnetic field with generally pincushion-shaped horizontal magnetic field and barrel-shaped vertical magnetic field, it is different from the conventional astigmatic magnetic field in that it positively provides the state of non-convergence.

Figure 1:
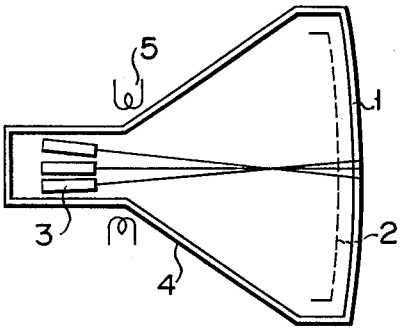
FIG. 1 is a sectional view schematically showing an in-line type color picture tube.
Figure 2:
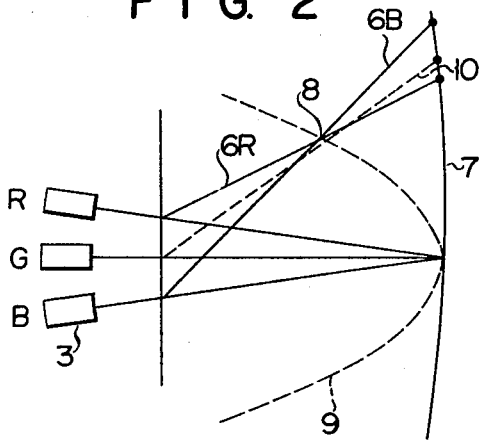
FIG. 2 is a schematic view illustrating the convergence error of electron beams in the color picture tube of FIG. 1.
Figure 3:
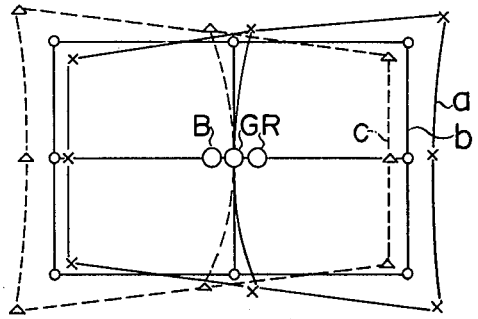
FIG. 3 shows the shapes of patterns on a phosphor screen, indicating the convergence error as illustrated in FIG. 2.
Figure 4A:
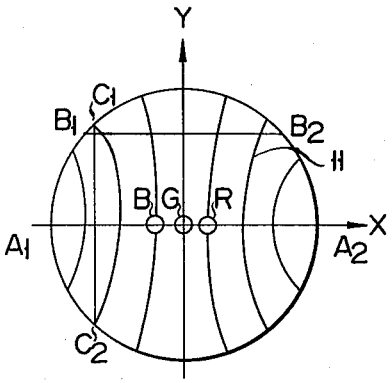
FIGS. 4A and 4B show the distribution of an astigmatic magnetic field of a conventional deflection yoke.
Figure 4B:
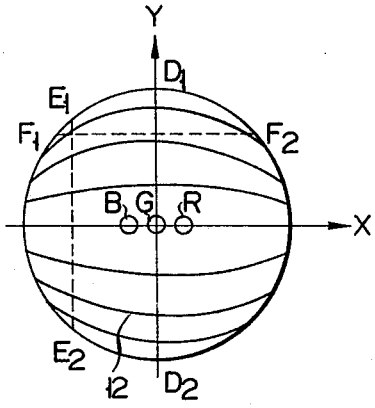
Figure 5A:
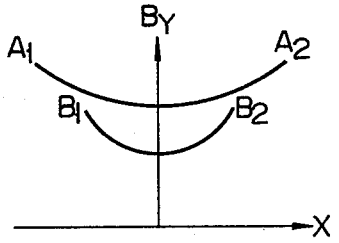
FIGS. 5A to 5D show the magnetic field intensity distribution at varied positions of the magnetic field distribution as shown in FIGS. 4A and 4B.
Figure 5B:
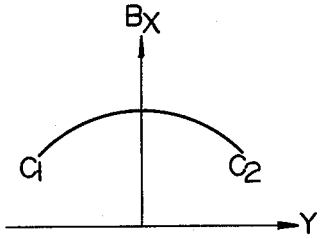
Figure 5C:
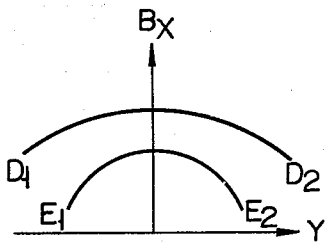
Figure 5D:
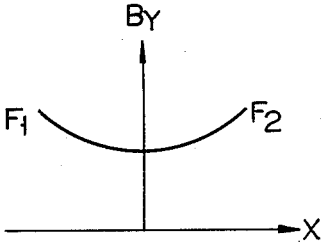
Figure 6:
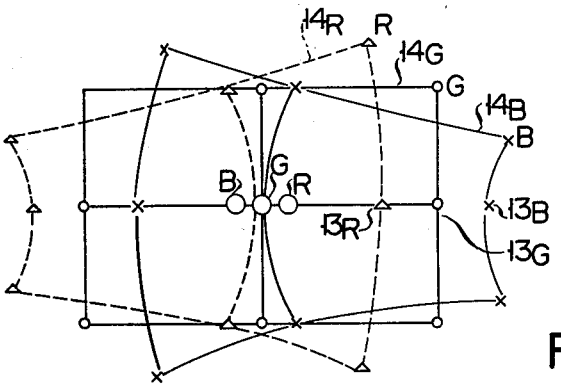
FIG. 6 shows the pattern shapes on the phosphor screen when both the horizontal and vertical magnetic fields are uniform.
Figure 7:
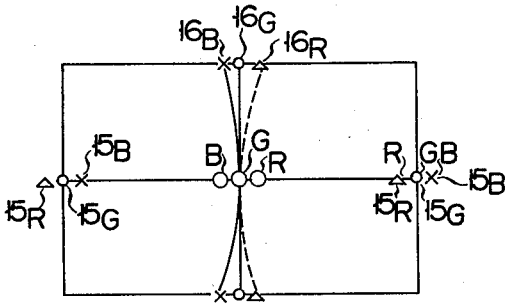
FIG. 7 shows the pattern shapes on the phosphor screen when the horizontal-deflection magnetic field is pincushion-shaped and the vertical-deflection magnetic field is barrel-shaped.
Figure 8:
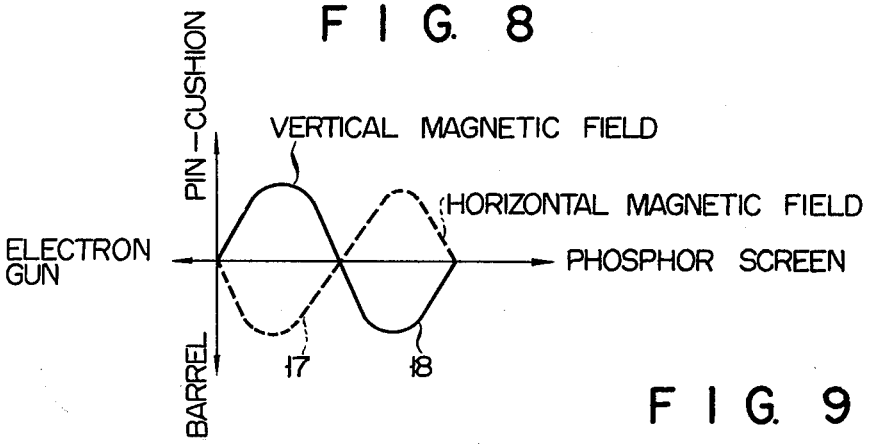
FIG. 8 shows the magnetic field distribution when the magnetic fields on the electron gun side and the phosphor screen side of the deflection yoke have each opposite polarity.
Figure 9:
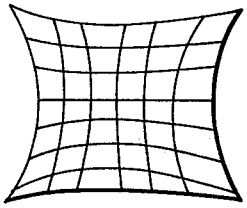
FIG. 9 shows the shape of a raster when there is used the deflection yoke to provide the magnetic field distribution as shown in FIG. 8.
Figure 10:
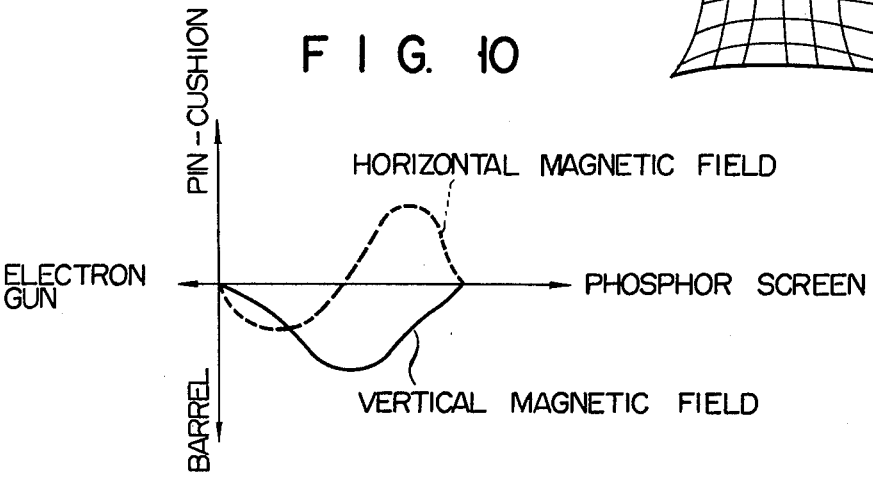
FIG. 10 shows an example of the magnetic field controller used with the deflection yoke, if any.
Figure 11:
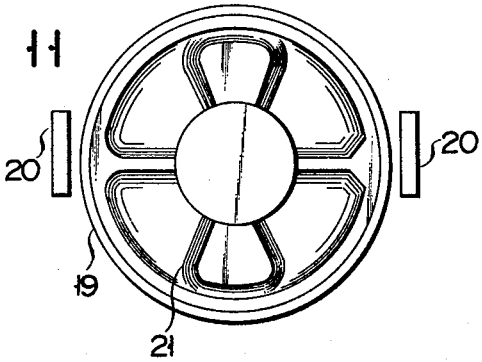
FIG. 11 is a plan of a conventional deflection means used with a monochromatic picture tube.
Figure 14A:
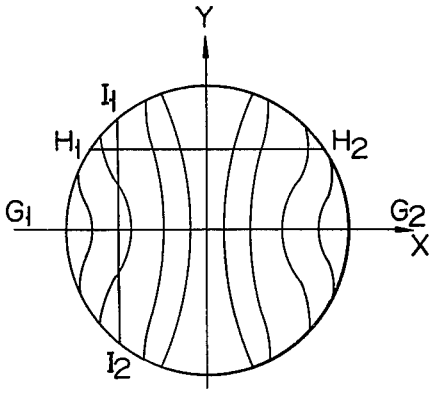
FIGS. 14A and 14B show the magnetic field distribution on a section perpendicular to the tube axis of the deflection means of FIG. 12.
Figure 14B:
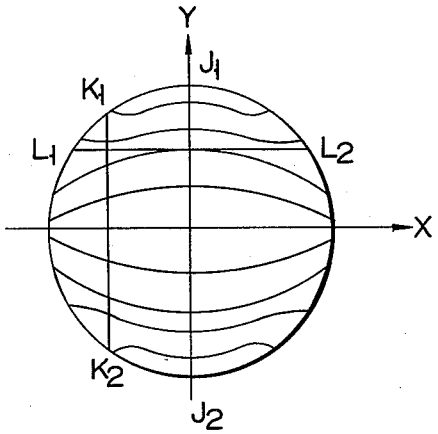
Figure 15A:
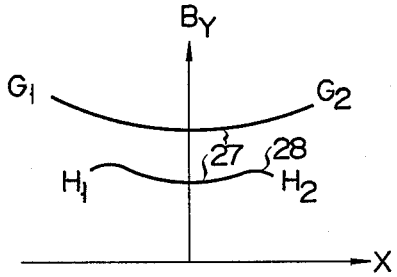
FIGS. 15A to 15D show the magnetic field intensity distribution at varied positions of the magnetic field distribution as shown in FIGS. 14A and 14B.
Figure 15B:
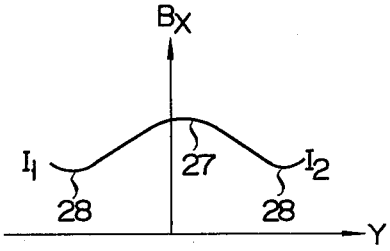
Figure 15D:
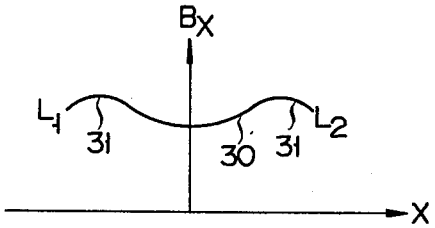
Figure 15C:
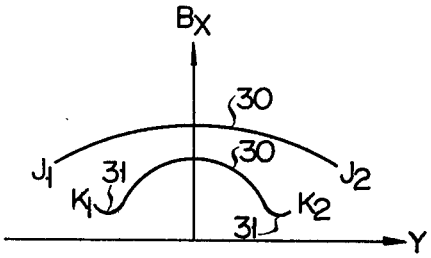

FIGS. 14A and 14B show the magnetic distribution of the aforesaid deflection means. FIG. 14A illustrates a horizontal-deflection magnetic field with a section perpendicular to the tube axis, while FIG. 14B illustrates a vertical-deflection magnetic field. FIG. 15A shows the magnetic field intensity $B_Y$ at positions $G_1$–$G_2$ and $H_1$–$H_2$ of FIG. 14A in the Y-axis direction, while FIG. 15B shows magnetic field intensity $B_X$ at position $I_1$–$I_2$ in the X-axis direction. Further, FIG. 15C shows magnetic field intensity $B_X$ at positions $J_1$–$J_2$ and $K_1$–$K_2$ of FIG. 14B in the X-axis direction, while FIG. 15D shows magnetic field intensity $B_Y$ at position $L_1$–$L_2$ in the Y-axis direction. As may be clear from FIGS. 14A, 15A and 15B, the horizontal deflection magnetic field includes a pincushion-shaped magnetic field 27 in the vicinity of the tube axis and a barrel-shaped magnetic field 28 at a portion sufficiently distant from the tube axis (corresponding to the diagonal periphery of the phosphor screen). Moreover, as may be seen from FIGS. 14B, 15C and 15D, the vertical deflection magnetic field includes a barrel-shaped magnetic field 39 in the vicinity of the tube axis and a pincushion-shaped magnetic field 31 at a portion sufficiently distant from the tube axis. By such magnetic fields of the deflection means, the raster distortion may be corrected substantially completely, and the electron beams are converged on the phosphor screen.

Now there will be described another example of the deflection means of the invention.

Figure 16:
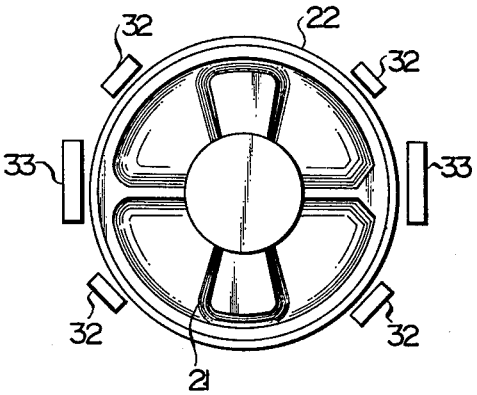
FIG. 16 is a plan of a deflection means used with the in-line type color picture tube according to another embodiment of the invention.

The deflection means as shown in FIG. 16 is formed of a deflection yoke 22 and correction deflection elements 32 and 33. That is, the correction deflection elements of this deflection means consist of four permanent magnets 32 arranged in positions beside the end portion of the deflection yoke 22 on the phosphor screen side and corresponding to the directions of the diagonal axes of the phosphor screen, and a pair of permanent magnets 33 arranged in positions beside the end portion of the deflection yoke 22 on the phosphor screen side and corresponding to the direction of the horizontal axis of the phosphor screen.

Figure 17:
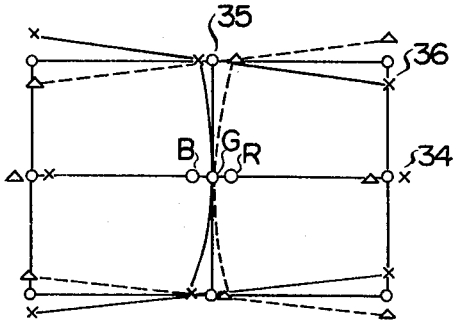
FIG. 17 shows the shape of a raster formed by means of a magnetic field generated by the deflection yoke of FIG. 16 only.

The magnetic field of the deflection yoke 22 according to this embodiment is so designed as to give positive isotropic astigmatism to three electron beams for substantial over-convergence state when deflecting the electron beams along the horizontal axis, give negative isotropic astigmatism to the electron beams for substantial under-convergence when deflecting the beams along the vertical axis, and hence give negative anisotropic astigmatism to the beams for substantial non-convergence when deflecting the beams along the diagonal axes. FIG. 17 shows the states of overconvergence 34, under-convergence 35, and non-convergence 36. Both these correction deflection elements 32 and 33 function so as to constrict the raster formed of the deflection yoke 22 at least in the directions of the diagonal axes and to extend the raster in the direction of the horizontal axis, providing such a magnetic field that may give positive anisotropic astigmatism or positive isotropic astigmatism to the three electron beams when these beams are deflected along the diagonal axes or the horizontal axis, respectively. The raster distortion is corrected and the non-convergence is countervailed by means of the pincushion shaped magnetic field of the correction deflection elements 32 and 33. Although the magnetic field of the afore-mentioned deflection yoke 22 (FIG. 16), like the magnetic field of the deflection yoke 22 as shown in FIG. 12, is a magnetic field which gives positive isotropic astigmatism to the three electron beams when deflecting the beams along the horizontal axis, it gives the positive isotropic astigmatism to a lower degree as compared with the magnetic field of the deflection yoke 22 of FIG. 12. Therefore, although the electron beams are converged to a higher degree as compared with the case of a uniform magnetic field, the state of convergence is not attained, and there is caused over-convergence. Such over-convergence may be countervailed by means of the permanent magnets 33 arranged in the horizontal-axis direction.

This invention has the following advantages. That is, especially the horizontal raster distortion may be corrected substantially completely. Namely, the turn-end effect, which will be caused if the screen side of the horizontal deflection coil is given as extreme pincushion shape or a saddle shape to correct the coma error, may be substantially completely eliminated by using permanent magnets to generate a static magnetic field for the correction deflection element. According to the deflection means of the invention, there may be formed an optical, desired magnetic field. Since the apparatus of the invention includes no correction circuit, the deflection yoke itself can be made fully compact. Further, especially in a large-sized tube, the convergence characteristic of the color picture tube exhibits large negative anisotropic astigmatism at the diagonal portions of the phosphor screen, increasing the convergence error. In the color picture tube of the invention, however, the convergence error is fully reduced and a satisfactory convergence characteristic may be obtained.

The correction deflection element in this invention is similar in shape to the distortion correction magnets in the monochromatic picture tube as mentioned above as a prior art example. The example of the prior art monochromatic picture tube cannot, however, be applied to the color picture tube, in which three electron beams are used instead of using a single electron beam, the diameter of the imaginary electron beam being quite different from that of the single electron beams. Thus, according to the invention, the raster distortion in the color picture tube may suitably be corrected by combining a deflection yoke to provide the aforesaid specified modes of astigmatism and correction deflection element formed of a plurality of permanent magnets.

In this embodiment, the correction deflection element may be arranged in positions facing each other in the horizontal and/or vertical directions, or in the diagonal and vertical directions, instead of being arranged in such a manner as the aforementioned examples. Such method of arranging the permanent magnets depends on the deflection angle of the color picture tube, the size of the phosphor screen and the like to some degree, and a variety of suitable arrangements may be selected. So far as the auto-convergence type color picture tube is concerned, however, preferably four permanent magnets should be arranged at least in the diagonal directions, as shown in FIG. 12. Moreover, the intensity, number, and size of the permanent magnets can suitably be selected; a plurality of small permanent magnets may be arranged in the diagonal directions.

Although examples of only the auto-convergence type color picture tube has been described herein, it is to be understood that this invention is not limited to these examples, and that the invention may be applied also to other types of color picture tubes with three-electron gun system.

Thus, this invention provides a quite novel auto-convergence type color picture tube, the industrial value of which is extremely high.

What we claim is:

1. An in-line type color picture tube apparatus, comprising:

an in-line type color picture tube including a phosphor screen for displaying a substantially rectangular picture with horizontal, vertical, and diagonal axes and an in-line electron gun arranged in parallel with said horizontal axis so as to be allowed to cast electron beams on said phosphor screen to reproduce a color image;

a deflection yoke disposed around the outer periphery of said tube and generating a magnetic field to give positive isotropic astigmatism to said electron beams when said electron beams are deflected along said horizontal axis, to give negative isotropic astigmatism to said electron beams when said electron beams are deflected along said vertical axis, and to give negative anisotropic astigmatism to said electron beams when said electron beams are deflected along said diagonal axis, the magnetic field generated by the deflection yoke providing the state of non-convergence along at least one of said horizontal axis, vertical axis and diagonal axis;

a correction deflection element formed of a plurality of permanent magnets arranged in the vicinity of the end portion of said deflection yoke on the phosphor screen side, generating a magnetic field to give positive anisotropic astigmatism to said electron beams when said electron beams are deflected along said diagonal axes, whereby the end portions of the diagonal axes of a raster formed of the electron beams by means of an action of the deflection yoke are constricted and said non-convergence is countervailed.

2. An in-line type picture tube apparatus according to claim 1, wherein:

the magnetic field generated by the deflection yoke provides substantially good convergence along said horizontal axis, provides substantial under-convergence along said vertical axis, and provides substantial non-convergence along said diagonal axes; and said correction deflection element is formed of four permanent magnets arranged in positions corresponding to the directions of the diagonal axes of said phosphor screen, whereby said under-convergence and non-convergence are countervailed.

3. An in-line type color picture tube apparatus according to claim 2, wherein:

the magnetic field generated by the deflection yoke 22 provides over-convergence along said horizontal axis; and said correction deflection element further includes a pair of permanent magnets arranged in positions corresponding to the direction of the horizontal axis of said phosphor screen, said pair of permanent magnets generating a magnetic field giving positive isotropic astigmatism to said electron beams when said electron beams are deflected along said horizontal axis whereby portions of said raster in the vicinity of the end portions of said horizontal axis are horizontally extended and said over-convergence is countervailed.

4. An in-line type color picture tube apparatus according to claim 1, 2, or 3 wherein said deflection yoke consists of a horizontal deflection coil to generate a pincushion-shaped magnetic field and a vertical deflection coil to generate a barrel-shaped magnetic field.

5. An in-line type color picture tube apparatus according to claim 1, 2, or 3 wherein the magnetic field generated by said deflection yoke and correction deflection element includes a horizontal deflection magnetic field which is pincushion-shaped in the vicinity of the tube axis and barrel-shaped in a position sufficiently distant from the tube axis, and a vertical deflection magnetic field which is barrel-shaped in the vicinity of the tube axis and pincushion-shaped in a position sufficiently distant from the tube axis.

* * * * *